United States Patent [19]

Clark

[11] 3,996,805

[45] Dec. 14, 1976

[54] PUSHBUTTON ASSEMBLY FOR A RADIO TUNER

[75] Inventor: Alfred James Clark, Palatine, Ill.

[73] Assignee: Motorola, Inc., Schaumburg, Ill.

[22] Filed: May 2, 1975

[21] Appl. No.: 574,189

[52] U.S. Cl. ..... 74/10.33; 74/483 PB; 200/159 R; 200/340; 334/7

[51] Int. Cl.[2] ..... H01H 3/12; H01H 13/14

[58] Field of Search ..... 200/159 R, 329, 340; 334/7; 235/145 R; 74/10.33, 10.37, 483 PB, 503; 197/98, 102

[56] References Cited

UNITED STATES PATENTS

| | | | |
|---|---|---|---|
| 2,469,189 | 5/1949 | Williams | 334/7 X |
| 2,884,503 | 4/1959 | Connelly | 200/340 |

*Primary Examiner*—Paul L. Gensler
*Attorney, Agent, or Firm*—Margaret M. Parker; James W. Gillman; Donald J. Lisa

[57] ABSTRACT

A pushbutton assembly has an actuating arm with a body portion and an outer end portion connected to the body portion by a narrowed portion. A pushbutton having a cavity and a slot leading from the rear wall to the cavity is retained on the arm by slipping the arm through the slot until the end portion enters the cavity, then twisting the end portion slightly around the longitudinal axis of the arm. The pushbutton can be released by realignment of the arm end portion with the body portion.

3 Claims, 4 Drawing Figures

Fig. 1
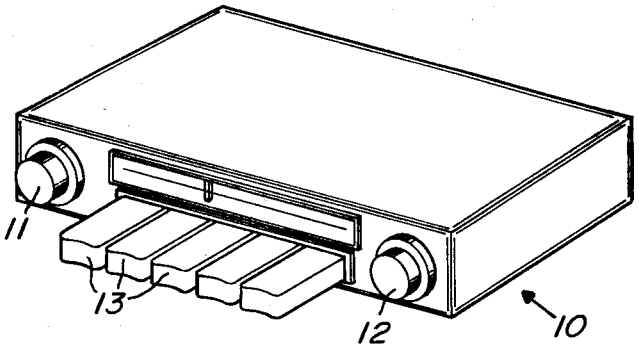
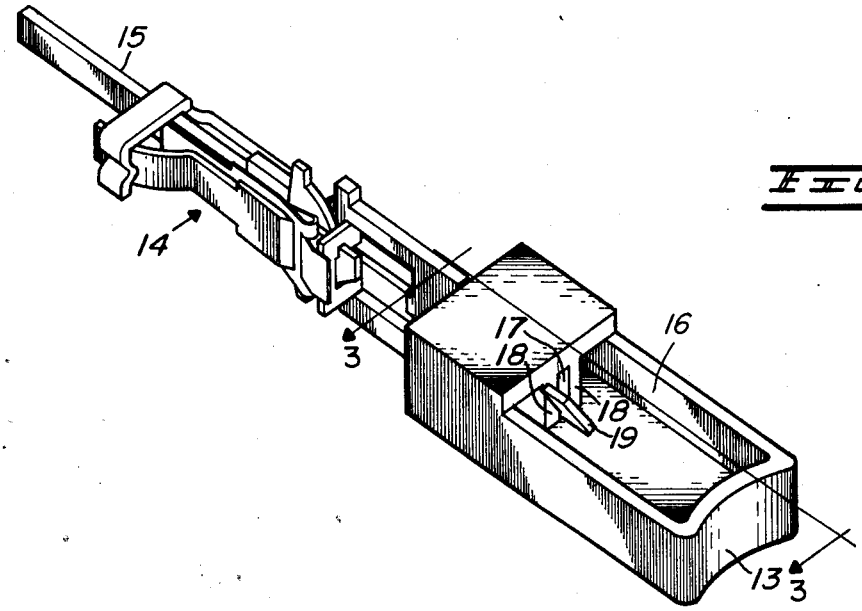
Fig. 2
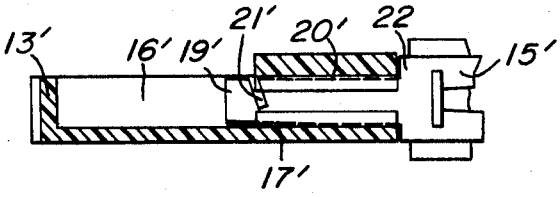
Fig. 4
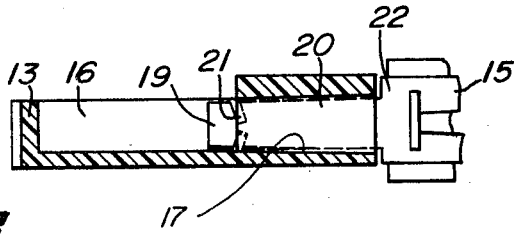
Fig. 3

PUSHBUTTON ASSEMBLY FOR A RADIO TUNER

BACKGROUND OF THE INVENTION

1. Field of the Invention

This invention relates to the field of pushbutton tuners and specifically to the attachment, retention, and release of pushbuttons from the actuating arms of the tuners.

2. Prior Art

Since the development of pushbutton type radio tuners there have been many approaches to the problem of attaching a pushbutton to the outer end of the actuating arm. These have gradually become simpler until, most recently, designs have typically been some kind of force-fit device, where the button was pressed onto the arm and some configuration of the arm, such as backward-pointing teeth, would bite into the material of the button and prevent its removal. However, buttons of this type were often broken during installation, and almost certainly during attempted removal. Since there was constant stress on the plastic button, it would sometimes break from the temperature changes experienced during shipping. Another recent approach was to have a hook lever portion of the actuating arm twist and bite into a slanted wall portion of the button. This was an improvement, but constant stress was still applied to the material of the button under the leverage of the actuating arm, and there was danger of breakage for this reason.

SUMMARY

It is therefore an object of the present invention to provide an improved means of attaching the pushbutton to an actuating arm, retaining it during use, and releasing it when so desired.

It is a more specific object to provide such a means which is easy and inexpensive to manufacture, and which will retain and release the button without damage to the button and without requiring special tools or special skills.

These objectives are provided in the present invention by a pushbutton having a cavity on its underside and a slot leading from the rear of the button to the cavity. The arm member which initiates selection of predetermined frequencies has an outer end portion of a dimension to be received by the pushbutton slot. The arm member has a body portion with dimensions substantially the same as those of the slot. Between these two portions is a narrowed portion which will allow the end portion to be rotated out of alignment with the body portion. There is a shoulder portion adjacent the body portion, opposite the end portion. The button can be removably retained on the arm member by inserting the arm member into the slot until the end portion is within the cavity, then rotating the end portion longitudinally. The button is then held without strain between the shoulder portion and the end portion.

BRIEF DESCRIPTION OF THE DRAWING

FIG. 1 is a perspective view of a radio tuner of a type to utilize the present invention.

FIG. 2 is a perspective of one pushbutton mounted on an actuating arm according to the invention.

FIG. 3 is a cutaway view of a pushbutton showing a preferred embodiment of the actuating arm inserted, but not fastened.

FIG. 4 is a cutaway view similar to FIG. 3 with an alternate arm embodiment in place but not fastened.

DETAILED DESCRIPTION OF A PREFERRED EMBODIMENT OF THE INVENTION

In FIG. 1, a typical radio tuner 10 is shown, having an on-off-volume control 11, a tuning control 12 and a plurality of pushbuttons 13 for selecting one of a number of predetermined frequencies.

FIG. 2 shows (upside down) a completely assembled actuating arm mechanism 14 which operates to establish and select certain desired frequencies. An actuating arm 15 supports the moving members of the mechanism and, on its outer end, the pushbutton 13. The pushbutton is typically molded of a suitable plastic material and is formed with a cavity 16 on the underside, a slot 17 leading from the rear wall of the pushbutton and connecting to the cavity and an interior wall 18. In FIGS. 3 and 4, a part of the arm 15 is shown in two embodiments, each inserted into the pushbutton (shown cut away and upside down). The arm includes an end portion 19, a body portion 20 and, connecting the latter two, a narrowed neck portion 21. In FIG. 3 the button slot 17 and the arm body portion 20 are similarly tapered. Thus, while the end portion 19 will pass through the slot 17 and into the cavity 16, the body portion 20 will be retained within the slot. To lock the pushbutton 13 on the arm, the end portion 19 of the arm is rotated slightly around the longitudinal axis of the arm as shown in FIG. 2, to abut the interior wall 18. To do so requires no particular skill and no special tool. To release the pushbutton, the end portion 19 of the arm is realigned with the body portion 20, making it possible to pull the button off without damage. A shoulder portion 22, which is shown on both embodiments of the arm, acts to prevent the pushbutton from sliding on the arm after the end portion has been twisted. It is to be noted that, according to the invention, the pushbutton is held firmly in place on the actuating arm with a minimum of stress applied to the plastic material. In other words, the end portion of the actuating arm is rotated around the longitudinal axis of the arm until the plastic pushbutton is restrained from moving in one direction by the shoulders of the arm and in the other direction by the twisted tab abutting the interior wall of the button. Thus, there is no tendency for the button to crack and the button can be removed without damage, should that prove to be necessary.

In FIG. 4, the body portion 20' of the arm 15' and the slot 17' of the pushbutton are not tapered and the pushbutton is held between the shoulder portion 22 and the end portion 19' after the latter is twisted out of alignment as aforesaid. The end portion 19 of FIG. 3 is symmetrical while the end portion 19' of FIG. 4 is asymmetrical. The operation of the two is the same and the appended claims cover both these and other embodiments which fall within the spirit and scope of the invention.

I claim:

1. In a pushbutton type radio tuner for selecting various ones of a number of predetermined frequencies, an improved pushbutton assembly comprising:

pushbutton means having a cavity on the underside thereof, an interior wall portion within the cavity and having a longitudinal slot leading from the rear of the pushbutton means to the cavity; and an arm member for initiating the frequency selection, the arm member having an outer end portion of a dimension to be received by the pushbutton slot, a body portion having substantially the dimensions of the slot, and a narrowed portion between the end and body portions, the body portion being received in the slot, and the end portion of the arm member extending into the cavity, the end portion coming into abutting relation with the end of the interior wall portion of the pushbutton when rotated out of alignment with the body portion, whereby the pushbutton is removably retained on the arm member.

2. The pushbutton assembly according to claim 1, the body portion of the arm member being tapered toward the outward end and the slot of the pushbutton means being adapted to receive the body portion of the arm member in a friction fit.

3. The pushbutton assembly according to claim 1 and wherein the arm member is formed with at least one shoulder portion adjacent the body portion for preventing motion of the pushbutton means on the arm member subsequent to rotation of the end portion of the arm member.

* * * * *